US005567911A

United States Patent [19]

Ekman

[11] Patent Number: 5,567,911

[45] Date of Patent: Oct. 22, 1996

[54] PARTICULATE EXPLOSIVE, MANUFACTURING METHOD AND USE

[75] Inventor: Gunnar Ekman, Nora, Sweden

[73] Assignee: Nitro Nobel AB, Nora, Sweden

[21] Appl. No.: 356,678

[22] Filed: Dec. 15, 1994

[30] Foreign Application Priority Data

Dec. 16, 1993 [SE] Sweden ..... 93041747

[51] Int. Cl.[6] ..... C06B 31/28

[52] U.S. Cl. ..... 149/46; 149/2

[58] Field of Search ..... 149/2, 46

[56] References Cited

U.S. PATENT DOCUMENTS

| | | | |
|---|---|---|---|
| 3,447,978 | 6/1969 | Bluhm | 149/2 |
| 4,248,644 | 2/1981 | Healy | 149/21 |
| 4,525,225 | 6/1985 | Cechanski | 149/19.5 |
| 4,585,496 | 4/1986 | Honeyman et al. | 149/21 |
| 4,632,714 | 12/1986 | Abegg et al. | 149/2 |
| 4,708,753 | 11/1987 | Forsberg | 149/2 |
| 4,784,706 | 11/1988 | McKenzie | 149/2 |
| 4,822,433 | 4/1989 | Cooper et al. | 149/2 |
| 4,844,756 | 7/1989 | Forsberg | 149/2 |
| 4,875,950 | 10/1989 | Waldock et al. | 149/21 |
| 4,994,124 | 2/1991 | Nguyen | 149/21 |

FOREIGN PATENT DOCUMENTS

| | | |
|---|---|---|
| 0152060 | 8/1985 | European Pat. Off. . |
| 0159171 | 10/1985 | European Pat. Off. . |
| 0194774 | 9/1986 | European Pat. Off. . |
| 0238210 | 9/1987 | European Pat. Off. . |
| 0250224 | 12/1987 | European Pat. Off. . |
| 0330637 | 8/1989 | European Pat. Off. . |
| 0393887 | 10/1990 | European Pat. Off. . |
| 803466 | 10/1936 | France . |
| 1306546 | 2/1973 | United Kingdom . |
| 2223972 | 1/1991 | United Kingdom . |

*Primary Examiner*—Charles T. Jordan
*Assistant Examiner*—John R. Hardee
*Attorney, Agent, or Firm*—Burns, Doane, Swecker & Mathis, L.L.P.

[57] ABSTRACT

An explosive in granulated or particulate form, wherein at least a part of the granules comprises an emulsion, having a continuous fuel phase and a discontinuous oxidizer phase containing oxidizing salts, and wherein the fuel phase is soft or deformable and at least a part of the oxidizing salts in the discontinuous phase is in solid crystalline or amorphous form. A method for the manufacture of an explosive in granular or particluate form comprises the steps of, forming an emulsion having a continuous fuel phase and a discontinuous oxidizing phase containing oxidizing salts, solidifying at least a part of the oxidizing salts in the discontinuous phase and granulating the emulsion. The granulated explosive may be charged, e.g. by blow-loading, into a hole in a material and initiated.

17 Claims, No Drawings

PARTICULATE EXPLOSIVE, MANUFACTURING METHOD AND USE

TECHNICAL FIELD

The present invention relates to an explosive in granulated or particulate form, wherein at least a part of the granules comprises an emulsion, having a continuous fuel phase and a discontinuous oxidizer phase containing oxidizing salts. The invention also relates to a manufacturing method for such an explosive and a preferred use thereof.

BACKGROUND

Granular or particulate type explosives have certain advantages over rigid, pumpable or pourable eqivalents in manufacture, transport and use. Once obtained in granular form, further processing, mixing and transport can be performed in simple equipments and without significant deposition problems. Generally the products are safe to handle as the uncompacted bulk granular explosive has low sensitivity and energy concentration and need not be subjected to the same high pressures, friction or shear as their more viscous counterparts during transport and charging. Special advantages are obtained in the charging operation where the granular explosive can be easily poured or blow-loaded into the bore-hole at the blasting site. In blow-loading the charging conduit and hose are empty between the actual charging operations, and have a low explosive concentration during the operation, which strongly facilitates manual manipulation of the otherwise heavy equipments and contributes to safety as the conduits will not transmit an accidental initiation at the bore-hole area to the charging device explosive storage vessel.

Several difficulties are encountered in the formulation of granular explosives for abovesaid purposes. As the energy concentration is low in the bulk granular explosive the particles must have the ability to be compacted under deformation. Deformability and a certain tack is also necessary to adhere the charge to the bore-hole walls and allow charging into vertical upholes. Rigid granules need to be structurally destroyed and disintegrated for compaction purposes, which increases dusting and spillage, increases the segregation tendency between different composition components, as generally in pulverulent mixtures, and exposes the inner surfaces to the surroundings. Even after compaction rigid particles give final charges with limited adhesion against bore-hole walls. If soft granules are used, the abovesaid problems can be reduced but instead difficulties arise in the handling steps preceding the charging operation where the more soft and tacky granules may tend to cake, sag and agglomerate instead of being stably maintained in the desired granulated form.

The standard commercial particulate explosive is ANFO (Ammonium Nitrate Fuel Oil) giving essentially the initially enumerated advantages but also the abovesaid disadvantages. The solid particles are compacted under disintegration of their initially porous structure, resulting in a less good absorption and distribution of the fuel oil added and a limited adhesion degree against the bore-hole walls. A certain spillage or loss of fines is unavoidable under all treatment and handling steps. The product is notoriously sensitive to water, in spite of numerous attempts over many years to improve its water resistance by various additives, and the explosive cannot be used in wet bore-holes and need to be protected against moisture during transport and storage. Mixtures of ANFO with emulsions or slurries, e.g. as described in U.S. Pat. No. 4,585,496 may have improved water resistance and charge density properties but still relies entirely on the ANFO component for granular characteristics, and agglomeration and deposition problems strongly increase with added amounts.

Emulsion explosives have excellent water resistant properties and have been used for long time and modified for many specific purposes but have not been successfully used as the main constituent in granular explosives. Emulsion explosives are generally tacky and viscous in nature and impossible to maintain in granular form. The U.S. Pat. No. 4,525,225 descibes an emulsion explosive having a continuous fuel phase containing a cross-linkable polymeric additive, giving rigid or semi-rigid emulsions. The rigid emulsions are suggested for use in granulated form. The product is not intended for compaction and the basic problem remains unsolved, that a hardening of the emulsion inevitably also results in a product with inferior compaction properties. High levels of solid salt are needed to make the product operable. Emulsions hardened by other means, for example by crystallisation, give similar problems and are neither suggested nor suitable for granulated products.

SUMMARY OF THE INVENTION

A main object of the present invention is to avoid the problems with hitherto used granular explosives. A more specific object is to provide a granular explosive with excellent compaction properties, yet with low tendency for agglomeration and deposition prior to charging. Another object is to provide a granular explosive suitable for blow-loading. Still another object is to provide a granular explosive useful for charging in inclined or vertical upholes. A further object is to provide an explosive with high water resistance before and after charging. Yet another object is to provide a granular exposive allowing high final charge densities. Another object is to provide a granular explosive of stable properties during storage. Yet another object is to provide such a granular product based on a water-in-oil or melt-in-fuel type emulsion as the main or sole constituent. A further object is to offer a suitable manufacturing method for the explosive.

These objects are reached by the characteristics set forth in the appended claims.

By using a water-in-oil or melt-in-fuel type emulsion of the initially defined type as basic constituent in the granulated material, several of the abovesaid objectives are met. The oleaginous continuous external phase of the emulsion secures high water resistance of the granules and, as the invention allows compaction without substantial destruction of the emulsion structure, the good water resistance properties extends also to the final charge. The granules and the charge will benefit from the inherent stability of this kind of emulsions and segregation problems, corresponding to those in pulverulent or solid/liquid mixtures, are not at all experienced. By selecting a fuel phase composition which is not stiff or hard but rather soft or deformable, the composition will have excellent compaction properties as the granules, contrary to most known hard granule types, may fuse under blowing or other tamping forces, in this case with a high degree of maintained emulsion structure. This property secures good cohesion in the charge and adhesion against the bore-hole walls, e.g. allowing efficient uphole charging. It also ensures high and reproducible charge densities, depending more on original emulsion formulation and less on charging conditions and operator skill. Efficient fusion of granules also reduces spillage, losses and backspray in the preferred blow-loading charge method. By securing a significant part of the oxidizing salts in solid crystalline or amorphous form, retained within the discontinuous phase droplets, the abovesaid rheologic properties are amplified. The product will be internally slightly more rigid, limiting granule sagging tendencies in transport and storage, without at the same time compromizing the deformable character rendered by the fuel phase, necessary for the abovesaid fusion properties. The solid salt, released through exposure of the internal phase at emulsion surfaces during manufacture and granule formation, also tend to facilitate drying of granule surfaces and formation of a thin surface layer of small crystals inhibiting granule agglomeration prior to charging. The salt solidification, or initiation of crystallisation, further serve to stabilize the granules by eliminating the possibility of a potential uncontrolled crystallization and improves safety by increasing activation energy and reducing initiability through friction, static electricity and impact. In a preferred manufacturing method shear and friction is applied on the emulsion during a granulation step to simultaneously release crystallization and rapidly initiate said internal hardening and surface skin formation.

Further objects and advantages will be evident from the detailed description below.

The Explosive Product

The explosive in granulated or particulate form, wherein at least a part of the granules comprises an emulsion as first stated herein, is characterized in that the fuel phase soft or deformable and that at least a part of the oxidizing salts in the discontinuous phase is in solid crystalline or amorphous form.

The emulsion used as main or sole ingredient in the granular explosive of the invention have a continuous lipophilic fuel phase and a discontinuous hydrophilic oxidizer phase. The discontinuous phase contains oxidizer to balance the fuel value of the continuous phase. Preferably sufficient oxidizer is included to give the emulsion as a whole an oxygen balance between −25% and +15%, better between −20% and +10% or substantially balanced. It is preferred to use emulsion compositions, which are explosives per se or will be explosives after charging, i.e. after having been subjected to the charging operation which may affect the composition for example in respect of mixing, compaction, gas release or air inclusion. Water-in-oil type emulsions useful for these purposes are described e.g. in U.S. Pat. No. 3,447,978, and melt-in-fuel emulsions in e.g. U.S. Pat. No. 4,248,644, all incorporated herein by reference, and in abundant subsequent patents. Such known compositions may be used as disclosed or may form the basis for suitable emulsions when configured with regard to the considerations given herein.

The emulsion fuel phase shall contain a carbonaceous oil, which may be freely selected as long as it has its usual fluid or mainly non-crystalline property at use temperatures, in sufficient amounts to secure the integrity of the discontinuous fuel phase at these temperatures. As common in emulsion explosives the oil may be supplemented with wax or other additives, such as polymers, for the purpose of enhancing viscosity. For the present purposes deformable but non-sticky emulsions are suitable and, although the salt phase contributes to the desired properties for reasons already discussed, it is preferred to include some viscosity enhancing aditives in the fuel phase. Preferred additives are crystalline fuels such as microcrystalline waxes. The amount depends on the rheology properties of the oil but as a general rule the fuel phase can contain at least 20 percent by weight, and preferably at least 40 percent, of such additives. To avoid a too rigid or fragile fuel phase the amount should be below 80 percent and preferably below 70 percent by weight of the fuel phase. The final emulsion, prepared from the fuel phase and the oxidizer phase as described hereinunder, should be sufficient soft or deformable to allow fusion of the granules with maintained continuous or non-particulate characteristics. Preferably such fusion shall take place with substantially maintained emulsion structure. Also preferred is that fusion is possible under normal forces used in charging and tamping.

The main components of the oxidizer phase are oxidizing salts, such as inorganic nitrates and optionally also perchlorates. Preferably several oxidizing salts are included to attain a high salt concentration in solution or a low melting point in more water-free formulations. Ammonium nitrate is generally present in addition to alkalli or alkaline earth metal nitrates and perchlorates.

For the purposes of the present invention the physical characteristics of the discontinuous oxidizer phase are critical. In common commercial emulsion explosives manufacture the oxidizer phase is kept above its crystallization temperature when emulsified into discontinuous droplets but is then cooled into a supersaturated state at ordinary use temperatures for the emulsion. The resulting droplets accordingly contains a homogeneous aqueous solution in case of water-in-fuel emulsions and a homogeneous salt/salt solution in case of melt-in-fuel type emulsions.

For reasons set out above the current emulsions shall have an oxidizer phase in which at least a part of the oxidizing salts in the discontinuous phase is in solid crystalline or amorphous form. The "discontinuous phase" here refer to what is confined within discrete droplets separated from other similar droplets by the continuous phase and excludes phase components that may have penetrated or bridged the discontinuous phase films.

As indicated, the solidified phases may be categorized into two general types, although intermediates may form and no sharp distinction can be found therebetween. In a first type the droplets are believed to solidify into an amorphous state without significant crystallisation. This type of emulsion can be obtained by methods known in the art and generally designated melt-in-fuels. Ordinarily a low water content, say below 5 percent by weight of the phase composition and prefereably below 4 percent, is needed. Normally additional salt types are included in the composition in order e.g. to obtain a sufficiently low melting temperature. Melting temperatures above about 90 degrees centtigrades are common. The amorphous solidification generally gives stable emulsion with suitable rigidity at lower levels of hard components in the fuel phase.

In a second type the salts in the discontinuous phase solidifies under at least partial crystallization. It is belived that in most instances several or multiple crystals are formed in each droplet. This crystalline solidification is generally preferred over the amorphous for best rheology and compaaction properties. Crystallisation can be induced in salt compositions of abovesaid low water contents, e.g. by recrystallisation of the amorphous phase or by controlled release of crystallisation during cooling. It is preferred, however, to use oxidizer phase compositions of higher water content, which facilitates crystallisation and give final discontinuous phase composition mixtures of crystals together with saturated aqueous salt solution wherein the elementary crystals are believed to be clearly smaller than the phase droplets. Suitable water contents for these purposes are above 7 percent and preferably above 9 percent by weight of the phase composition. Too high water contents again may counteract crystallisation and the content should be below 20 percent and preferably below 16 percent. In both low and high water content compositions crystallisation can be initiated by by known means, e.g. U.S. Pat. No. 4,632,714, incorporated herein by reference, or preferably by the also known method of subjecting an already cooled emulsion containing supersaturated solution to sufficient friction or impact to activate crystallisation.

At least a part of the discontinuous phase salt shall be solidified. In case of amorphous solidification essentially all of the phase solidifies. In case of crystalline solidification various crystallisation degrees can be obtained. It is suitable that at least 25 percent, preferably more than 50 percent and most preferably above 75 percent of the oxidizing salts in the discontinuous phase is crystallised. The percentages are given in relation to the salt amounts that can crystallise at the temperature considered, normally the use temperature, i.e. disregardeing the salt remaining in a saturated solution in equilibrium with the crystals. Also disregarded is salt not confined within the discontinuous phase droplets, as defined and explained. Good results have been obtained with emulsions in which substantially all of the so defined salt has been crystallized.

The crystallisation pattern can be analysed or followed by for example calometry or DTA (Differential Thermal Analysis). Amorphous solidification is caracterized in a uniform temperature versus energy loss curve whereas crystallisation is caracterized by non-uniform such rates caused by temporary stabiliisations of the temperature, from initiation to final consumption, of the various salts and salt combinations. The crystallisation degree can be determined by measuring the energy release at crystallisation of the oxidizer phase composition in bulk form, to an equilibrium state, and comparing that with the energy release from the corresponding oxidizer phase amount in the emulsion, possibly with correction for any crystallisation in the fuel phase such as from microcrystalline wax.

As in emulsion explosives in general, it is ordinarily necessary to include a water-in-oil type emulsifier in order to stabilise the emulsion and for the present purposes also to allow the desired crystallisation within the droplets of the discontinuous phase. Any known emulsifier fulfilling these requirement may be used such as sorbitan fatty acid esters, glycol esters, unsaturated substituted oxazolines, fatty acid salts and derivates thereof. Generally the emulsifiers comprises a lipophilic part and a hydrophilic part with a possible link therebetween. For the present purposes it is advantageous to use emulsifiers with lipophilic parts of fairly high molecular weight, which not only stabilize the emulsion in the intended manner but also contributes to fuel phase theology properties suitable for granulation. The lipophilic part of the emulsifier may have a weight average molecular weight (Mw) above 200, preferably above 500. Too stiff emulifiers should be avoided and the molecular weight can be kept below 3000 and preferably also below 2500. It is further preferred that the high molecular weight lipophilic part of the emulsifier is polymeric in nature. Polymers including isobutylene monomer such as polyisobutylene may be used in the lipophilic part. It is further preferred that the hydrophilic part of the emulsifier comprises an amine, preferably secondary amine or most prefereed a tertiary amine. A suitable group of amines is the alkanolamines. It is further preferred that the emulsifier comprises a salt between the amine and at least one carboxylic group. The link between the lipophilic and the hydrophilic parts may suitably comprise a polyvalent acid or anhydride, succinic acid or anhydride in particular. Suitable emulsifier suggestions and alternatives within abovesaid limitations are disclosed for example in the U.S. Pat. Nos. 4,822,433, 4,844,756, 4,708,753, and 4,784,706, all incorporated herein by reference.

Also in similarity with common emulsion explosives the emulsion matrix for present purposes may include sensitizing agents, such as self-explosive additives but preferably density reducing agents. The requirement for such additives may vary strongly depending on the intended product use. The granulated product can be loosely filled into a bore-hole with substantial volumes of air between the granules. Charging under compaction may entrap varying amounts of air in the charge, thereby reducing the density reduction requirements for the matrix itself. Yet, in order to secure a reliable initiability of the matrix independent of charging conditions, it is preferred to include at least a minimum amount of density reducing agents in the emulsion, e.g. to a density below 1.25 g/cc or preferably below 1.2. Generally the density is kept above 0.8 and preferably also above 0.9 g/cc. Further density reduction may be used to obtain compositions of reduced strength although it is preferred to use other methods for this purpose as will be further discussed below. Any known density reduction method can be used, such as air inclusion or chemical gassing although it is preferred to include microspheres such as thermoplastic spheres and in particular the more volume stable glass or mineral spheres.

Other common additives than sensitizers may be included in the emulsion, such as aluminum powder to increase energy content, inert fillers to reduce energy, particulate flame-coolant salts for use in inflammable environments etc.

The final emulsion can have a conventional composition, e.g. comprising about 3 to 10 percent by weight of fuel including an emulsifier, about 8 to 25 percent by weight of water, about 50 to 86 percent by weight of oxidizing salts and possibly other additives in an amount up to about 20 percent by weight, such as an auxiliary fuel or fillers.

As indicated, various additives may be included in the emulsion body as such, although it is preferred to keep the amounts of non-compulsory additives low here. Similarly, additives may be included within the granules but outside the emulsion phase or body. Even this kind of exterior additives within the granules should be kept low and the major part of the granules should be made up of the emulsion as described, preferably above 80 percent or better above 90 percent by weight of the granules and for most purposes substantially all of the granule volume. Larger additive amounts are preferably mixed with the granules as a separate particulate or fluid component.

One preferred composition of the last mentioned type is a mixture of the emulsion containing granules with particulate oxidizer salt, e.g. ammonium nitrate, or oxidizer/fuel mixture, e.g. ANFO, in order to obtain intermediate properties. Any ratio between the two components can be used, from essentially pure ANFO, via such an explosive with e.g. improved water resistance and charge density, to the full benefits of the present product.

Another preferred particulate composition is between the present emulsion containing granules and an inert and/or density reducing filler in order to give an overall composition of reduced energy content, e.g. for careful blasting. Any known kind of particulate filler or bulking agent can be used.

Substantially homogeneous materials of high density can be exploited to provide for high composition density in spite of low strength, e.g. for the purpose of expelling water from drill holes. For this purpose inorganic materials are preferred, such as minerals or inert salts of the sodium chloride type, which latter type also may serve the purpose of reducing the igniting properties of the explosive. High density additives gives low segregation problems in the combined bulk material. To lower the overall density of the composition it is suitable to employ bulking agents of clearly lower density than that of the emulsion granules, e.g. below 0.8 g/cc. Advantageously the density is also lower than about 0.5 g/cc and more suitably lower than 0.3 g/cc. Porous inorganic bulking agents are substantially inept and can be used in the present compositions. Typical representatives for this filler category are expanded glasses, perlite, vermiculite, pumicite etc. The low filler mass introduced by lightweight materials permits use of organic materials with a certain fuel value. Organic fillers are available in bulk densities below 0.1 g/cc or even below 0.05 g/cc. Typical products of this kind suitable for the present purposes are expanded polymers of for example vinyl chloride, ethylene, phenol, urethane and especially styrene. Irregular particles, formed for example in subdivision of porous bulk materials, can be used although uniform particles and especially spherical particles, for example produced by expansion of discrete particles or droplets, are preferred. Satisfactory results have been obtained by spherical porous particles of preexpanded polystyrene foam beads. Especially for smaller addition amount the particle size is not critical and fine material of e.g. less than 1/10 or even 1/100 of granule size can be used. It is generally preferred though, especially for larger amounts, to use fairly large particle sizes and narrow size distributions. Particle sizes between 0.5 and 10 mm, or better between 1 and 5 mm, are then suitable. The bulking agent shall be added in an amount sufficient to reduce composition volume strength below the volume strength of the straight emulsion granules, here used as standard for relative volume strength. To be useful for careful blasting, the relative volume strength should be clearly lower than 100%, say below 80%, better below 60% and preferably also below 40%, established by calculations or experiments for specific compositions.

In many applications the explosive may with preference be used with the emulsion containing granules as the main or sole component in the explosive, e.g. to obtain high energy concentration or good compaction and coherence properties. The amount of emulsion containing granules in the explosive can then be above 80 percent by weight, preferably above 90 percent or substantially entirely consisting of such granules.

Product Manufacture

Methods for the manufacture of an explosive in granular or particluate form, generally comprise the steps of a) forming an emulsion having a continuous fuel phase and a discontinuous oxidizing phase containing oxidizing salts, b) solidifying at least a part of the oxidizing salts in the discontinuous phase and c) granulating the emulsion.

In the first step any known or conventional emulison preparation method can be used, such as any method described in the references given herein. Usually a mixture of the fuel phase components, the emulsifier and the oxidizer phase components, in dissolved or molten form, are emulsified in a high shear mixer or a static mixer at a temperature elevated above the softening point for the fuel phase components and the solidification temperature for the salt composition. Generally the temperatures required for keeping melts above their solidification temperature are higher than the temperatures for keeping solutions over their crystallisation temperature. After emulsion formation the emulsion is normally cooled to use temperatures. This cooling step may be affected by the desired solidification pattern for present purposes.

The second, solidification, step may be different for different oxidizer phase compositions. Low water content compositions intended to be solidified into amorphous form often requires nothing else than a fairly rapid cooling of the emulsion and absence of conditions facilitating crystallization. Once obtained in amorphous form, the state may be stable with low tendency for rearrangement. As well known in the art, cooling of emulsions and high water content emulsions in particular normally result in a supercooled state in which each droplet remains in solution despite its potential crystallization ability. This property is utilized and beneficial in normal emulsion explosive application but need to be overcome for the present purposes. Crystallization can be initiated in the emulsion during cooling, for example by securing presence of conditions facilitating crystallization, such as providing nucleating agents in accordance with known methods, by slow cooling or by disturbed cooling. It is generally preferred, however, to separate these actions and in a first step supercool the emulsion below its crystallization temperature, preferably to substantially ambient temperature in a conventional manner, and in a second step initiate crystallization. This method has proven to give emulsions of suitable rheological properties and also give the advantage of full control over the crystallization moment, at any time between emulsion matrix formation and the charging operation. This freedom can for example be used to initiate crystallization in connection with or at the actual charging operation to thereby utilize the hardening and phase transition for better bore-hole charge cohesion. But it is generally preferred to initiate crystallization earlier to take full advantage of abovesaid benefits in manufacture, storage, transport and use. Initiation can take place between formation of the supercooled emulsion matrix and granulation but preferably it is made at or soon after granulation for reasons to be explained below. Second step initiation after cooling can be made with the same means mentioned for initiation during cooling but an additional and preferred possibility is to utilize the per se known method of releasing crystallization through mechanical stress, e.g. by sufficient friction, shear or impact to activate crystallization, which manifests itself through a distinct sensible energy release and temperature raise. The method gives a beneficial fine-grained crystal structure, which may be further amplified with optional addition in the oxidizer phase of crystal habit modifiers, such as formamide or urea.

In the granulation step any known granulation method can be used, such as pan granulation for drier emulsion compositions. For the more suitable viscous emulsions it is preferred to divide granulation into a shaping step and a cutting step. Shaping may include formation of a sheet or slab of the emulsion which is then cut in one or two dimensions. A preferred method is to shape the emulsions into strings, preferably by extrusion through a hole-plate or screen, followed by cutting of the continuous strings into suitable lengths, preferably by use of knives or wires moving across the extrusion head openings. For emulsions susceptible to mechanical stress crystallization it is preferred to impose sufficient stress during the granulation steps to initiate the crystallization. The resulting heat generation facilitates cutting and accelerates drying with the desired skin formation while the resulting hardening is syncronised with the need for more rigid granules just when formed and collected. A manageable product is obtained within seconds from granule formation. The granule shape is not critical although the most preferred shape is roughly cylindrical. Granule sizes may vary depending on the intended charging method and desired bulk density. As a general indication, the weight average particle size of the granules containing emulsion corresponds to a spherical particle of equal volume having a diameter of 1 to 15 mm or preferably 2 to 12 mm.

Internal additives to be included in the emulsion body, such as density reducing agents or auxiliary fuels, may be included within the components to be emulsified but are with preference added to the emulsion matrix obtained after emulsion formation and cooling but before granulation. When a stress initiation step is included, the additives are with preference mixed into the emulsion before that step. External additives to be included in the composition outside the emulsion body, such as particulate oxidizer or energy reducing fillers, may be added after granule formation and with preference after a stress crystallization step when present, unless initiation is to be postponed for purposes set out above.

Product Use

The granulated product can be used for any blasting purpose but is mainly intended for commercial blasting applications, rock blasing in particular. The product can be designed sufficiently sensitive for use under unconfined conditions but is prefereably made insensitive enough not to be initiable in unconfined and uncompacted form. Hence the explosive is mainly used under confined conditions by being charged into a cavity in a material to be blasted followed by initiation, such as in bore-holes in a rock face.

The product can be placed in the confinement without compaction and accordingly with a charge density roughly corresponding to the bulk density of the granulated product. It is preferred, however, to use the product in such a way that the charge density is higher than the bulk density of the granulated explosive before charging. If X represents the fully compacted material, in the sense of having the same bulk density as the density within the granules before charging, Y represents said granule density, or average granule density for particulate mixtures, before charging and D represents the actual charge density, it is preferred to use compaction degrees, expressed as $100*(X-D)/(X-Y)$, above 10, preferably above 40 and most preferably above 70.

Any chafing method may be used, such as pouring the granulate into the hole with optimal mechanical tamping of the charge, incremental or final. A preferred charging method is blow-loading in which the advantages of the product is fully utilized. Conventional methods and devices may be used in this connection, such as blowing from pressurized vessels or blowing with direct injection of pressurized gas or a combination thereof. The compositions easily charge in this way without equipment deposits and compacts to high final charge densities.

Compacted charges may be used in bore-holes of all kinds, including down-holes, horizontal holes and upwardly inclined or vertical upholes, the latter types utilizing the good adhesion properties in charges formed from the present product, which may be further improved by the embodiment mentioned, wherein the oxidizing salts are brought into solid crystalline or amorphous form during or after charging.

The product may be used in any blasting application but the most typical applications are similar to those where ANFO is presently used although the water resistance of the present charges extends the use also to water filled holes. Special advantages are obtainable in careful blasting applications since the granules are easily combined with energy reducing fillers as described. The proposed compositions may then be used whenever a blasting composition with a volume strength reduced in relation to the compacted or uncompacted product is needed or whenever a blasting composition with readily variable strength is desired. Typical applications are contour blasting or pre-splitting above or underground as well as bench blasting for particular purposes. In underground mining and stoping, drift holes or production holes may be charged to full strength and the contour holes with reduced compositions. The reduced compositions may be plant-mixed but greater flexibility may bee achieved by on-site mixing of the present granules with the energy reducing filler.

Typical bore-hole sizes are from 32 mm and up. Normal bore-hole diameters for careful blasting are between 38 and 51 mm. Generally the final charges are insensitive enough to regire initiation by primer but cap-sensitive compositions may be configured.

EXAMPLES

In the following examples all the emulsions were prepared roughly in the same manner. A fuel phase was prepared by mixing emulsifier, oil, wax and possible PIBSA component under heating to about 80 degrees centigrades. The oxidizer phase was prepared by dissolving the oxidizing salts in the water under heating to about 85 degrees centigrades for the water containing compositions and by melting the salts and urea at about 150 degrees Centigrade for the water free compostitions. The two phases were emulsified at roughly the abovesaid oxidizer phase temperatures in a high shear mixer (CR-mixer for plant mixed compositions or hand-held rotary mixer for laboratory mixed compositions) until stable viscosity was obtained. The auxiliary componentes (microspheres, aluminum flakes and styrofoam beads) were mixed into the so formed emulsion while still hot. The emulsion compositions were then allowed to cool at ambient temperature before the granulation step. The emulsion compositions are given in the Table.

EXAMPLE 1

An emulsion composed as composition 1 in the Table was prepared as outlined. The cooled composition was squeezed into a slab with a thickness of about 5 mm under sufficient stress to release crystallization, detected as a substantial temperture rise in the composition. The sheet was cut into small 5×5 mm squares by use of a roller knife. The collected granules were blow-loaded from a pressurized vessel into the lower end of a vertical 39 mm internal diameter plastic tube. The charge adhered to the tube walls and had an approximate density of 1.1 g/cc. The charge detonated completely when initiated with a full area primer.

EXAMPLE 2

An explosive according to composition 2 in the Table was prepared was manufactured as outlined. The cool composition was pressed by a piston/cylinder arrangement through a hole plate with numerous 5 mm diameter holes and cut by a moving wire at exit into about 5 to 10 mm lengths. During the extrusion and cutting operation a temperature rise estimated to 10 to 20 degrees Centigrade increase was clearly detectable. The granules were collected and later charged manually into a 39 mm internal diameter plastic tube and tamped to a charge density of about 1.15 g/cc. During charging and tamping no temperature increase could be detected. The charge was shot with a full area primer and a velocity of detonation (VOD) of 3240 m/sec was obtained.

EXAMPLE 3

The procedure of Example 2 was repeated with compositions 3 and 4 in the Table. The resulting granules were soft with non-sticky surfaces. When shot VOD was measured to 3420 and 3360 m/sec respectively. No temperature rise was noticed during the charging and tamping procedure, indicating most complete crystallization before charging operation.

EXAMPLE 4

From compositions 1, 2 and 3 in the Table granulated explosives were manufactured with the method of Example 2. The granulated products obtained were stored at ambient temperature for 6 months. After storage the granules were still soft and un-agglomerated and were blow-loaded and shot with full detonation.

EXAMPLE 5

Granulated explosives from compositions 2 and 3 in the Table were manufactured according to the method in Example 2, save that the holes in the hole plate had diameters of 4 mm. The products were transported and vibrated on a fork-lift during an 8 our shift. No agglomeration could be detected and the product charged and shot with full detonation.

EXAMPLE 6

Granulated explosive from composition 4 in the Table was manufactured according to Example 2 with 5 mm diameter granules. The product was used to charge by blow-loading from a pressurized vessel a complete tunnel round consisting of 64 holes with dimeter 40 mm and depth 3.6 m. The result was at least as good as with a similar composition in bulk form.

EXAMPLE 7

Granulated explosive from composition 2 in the Table was manufactured according to Example 2, although with 4 mm diameter granules. The product was chaarged upwardly into a 6 m long 75 mm internal diameter plexi-glass tube using blow-loading from a pressurized vessel. A coherent charge was formed with only limited backspray of explosive.

EXAMPLE 8

An explosive was manufactured from composition 6 in the Table and was allowed to cool. The product was cautiously granulated by hand into spheres in such a manner as to avoud lease of crystallizaton. The granules obtained were softer and had a more sticky surface than the granules in the preceding examples.

EXAMPLE 9

An explosive was prepared from composition 5 in the Table and was granulated as described in Example 1 under fully detectable temperture rise from crystallisation. The granules had a slightly sticky surface End a small amount of larger crystals within the granules.

EXAMPLE 10

A melt-in-fuel type emulsion explosive was prepared from composition 7 in the Table and was granulated as described in Example 1 under fully detectable heat release from crystallization. The granules were soft and had a non-sticky surface and could be stored without agglomeration and could be compacted by tamping after storage.

TABLE

| Comp. | 1 | 2 | 3 | 4 | 5 | 6 | 7 |
|---|---|---|---|---|---|---|---|
| AN | 73 | 73 | 73 | 73 | 73 | 73 | 68 |
| SN | 10 | 10 | 10 | 10 | 10 | 10 | 18 |
| Urea | | | | | | | 8 |
| Water | 10 | 10 | 10 | 10 | 10 | 10 | — |
| SMO | | | | | 1 | | |
| PA | 1 | 1 | 1 | 1 | | 1 | 1 |
| PIBSA | | | | | 0.5 | | |
| Amine | | | | | | | |
| Oil | 2 | 2 | 3 | 3 | 1 | 2 | 2 |
| Wax | 2 | 2 | 1 | 1 | 3 | 2 | 2 |
| MS | 2.0 | 2.2 | 2.1 | 2.2 | 2.0 | 2.0 | 2.55 |
| Al | | 5 | | 5 | | | |
| Styr | | | | | | 2 | |
| Dens. | 1.22 | 1.21 | 1.20 | 1.22 | 1.19 | 0.80 | 1.20 |

Explanations:

| | |
|---|---|
| AN | Ammonium Nitrate. |
| SN | Sodium Nitrate. |
| Urea | Karbamide. |
| Water | Tap water. |
| SMO | Sorbitan monooleate (SPAN 80). |
| PA | Emulsifier based on polyisobutylene substituted succinic anhydride reacted with N,N-diethylethanolamine. |
| PIBSA | Polyisobutylene substituted succinic anhydride. |
| Amine | N,N-diethylethanolamine. |
| Oil | KAYDOL oil. |
| Wax | 50/50 microcrystalline/paraffin wax. |
| MS | Glass microspheres (Q-cell 723) |
| Al | Paint grade aluminium flakes. |
| Styr | Preexpanded styrofoam beads (BASF P402). |
| Dens. | Final emulsion density in g/cc. |

I claim:

1. Explosive in granulated or particulate form, wherein the major part of the granules comprises an emulsion having a continuous fuel phase and a discontinuous oxidizer phase containing oxidizing salts, and wherein the fuel phase is soft or deformable upon compaction so as to enable compaction in the absence of any substantial destruction of said emulsion structure, at least a part of the oxidizing salts in the discontinuous phase is present in a solid crystalline or amorphous form, the surfaces of said granules are at least partially covered by dry crystals of said oxidizing salts of said discontinuous phase that are capable of inhibiting agglomeration of adjacent granules prior to charging, and the amount of emulsion containing granules in the explosive is above 90 percent by weight.

2. The explosive of claim 1, wherein the weight average particle size of the granules containing emulsion corresponds to a spherical particle of equal volume having a diameter of 1 to 15 mm.

3. The explosive of claim 1, wherein said granules comprise above 90 percent by weight of said emulsion.

4. The explosive of claim 1, wherein the emulsion has a water content above 5 percent by weight.

5. The explosive of claim 1, wherein the discontinuous phase comprises crystalline oxidizing salts.

6. The explosive of claim 5, wherein the major part of the crystals of the oxidizing salt have a particle size less than the droplets of the emulsion discontinuous phase.

7. The explosive of claim 5, wherein the crystallization degree in the discontinuous phase is at least 25 percent by weight.

8. The explosive of claim 1, wherein the continuous fuel phase contains up to 75 percent by weight of a solid fuel.

9. The explosive of claim 1, wherein the emulsion contains a water-in-oil type emulsifier, having a lipophilic part and a hydrophilic part.

10. The explosive of claim 9, wherein the lipophilic part of the emulsifier has a weight average molecular weight (Mw) above 200.

11. The explosive of claim 9, wherein the lipophilic part of the emulsifier is polymeric.

12. The explosive of claim 11, wherein the lipophilic part of the emulsifier comprises polyisobutylene.

13. The explosive of claim 9, wherein the hydrophilic part of the emulsifier comprises an amine.

14. The explosive of claim 13, wherein the emulsifier comprises a salt between the amine and at least one carboxylic acid group.

15. The explosive of claim 9, wherein the link between the lipophilic and the hydrophilic parts comprises an anhydride or polyvalent acid.

16. The explosive of claim 15, wherein the link comprises succinic acid or succinic anhydride.

17. The explosive of claim 9, wherein the lipophilic part of the emulsifier has a weight average molecular weight (Mw) above 500.

* * * * *